United States Patent [19]

Adams

[11] 3,947,950

[45] Apr. 6, 1976

[54] APPARATUS AND METHOD FOR BEADING TUBES

[75] Inventor: Charles L. Adams, Euless, Tex.

[73] Assignee: Pressure Vessels, Inc., Fort Worth, Tex.

[22] Filed: June 24, 1974

[21] Appl. No.: 482,155

[52] U.S. Cl. ..... 29/523; 29/157.4; 29/243.52; 72/370; 72/393

[51] Int. Cl.[2] ..... B23P 11/02

[58] Field of Search..... 29/243.52, 243.5, 244, 29/252, 282, 283, 157.4, 523, 522, 512, 509, 505; 72/393, 392, 367, 370

[56] References Cited

UNITED STATES PATENTS

| | | | |
|---|---|---|---|
| 688,429 | 12/1901 | Monroe | 72/393 |
| 866,644 | 9/1907 | Green | 29/243.52 |
| 1,102,163 | 6/1914 | Opperud | 29/157.4 |
| 1,111,650 | 9/1914 | Frank | 72/393 |
| 1,133,014 | 3/1915 | Faessler | 29/157.4 |
| 1,306,982 | 6/1919 | Walsh | 29/243.52 |
| 1,381,406 | 6/1921 | Findley | 29/243.52 |
| 1,425,426 | 8/1922 | Vogt | 29/243.52 |
| 1,716,429 | 6/1929 | Davies | 29/523 |
| 3,628,227 | 12/1971 | Blackburn | 29/157.4 |

*Primary Examiner*—C. W. Lanham
*Assistant Examiner*—James R. Duzan
*Attorney, Agent, or Firm*—Wm. T. Wofford

[57] ABSTRACT

The specification discloses an apparatus and process for beading the projecting ends of heat exchange tubes to a header or tube sheet of a water heater. The apparatus comprises an expandable mandrel having outwardly movable jaws supported around the forward end of a spindle. The mandrel is adapted to be inserted into a tube and to be expanded outward to tightly grip the inside of the tube near the header and to expand the tube against the header. An annular beading head having an annular beading groove is supported around the spindle rearward of the jaws and is adapted to be moved forward to engage the groove with the projecting end of the tube to force the end of the tube radially outward and against the side of the header.

13 Claims, 13 Drawing Figures

APPARATUS AND METHOD FOR BEADING TUBES

BACKGROUND OF THE INVENTION

This invention relates to an apparatus and method for beading the projecting end of a tube to a header or tube sheet and which allows the beading operation to be carried out rapidly and effectively.

Large hot water heaters manufactured for commercial purposes basically comprise a cylindrical container having a top and bottom header with a multiplicity of open ended tubes extending through the container and which are held in place by the headers. Water within the container is heated by a gas flame applied to the bottom thereof and the tubes act to more effectively distribute the heat to the water and hence increase the heating efficiency.

In the conventional process of manufacturing the heaters, the tubes are inserted through apertures formed through the headers and the upper ends of the tubes are expanded into tight contact with the upper header. At the lower end, the projecting ends of the tubes are beaded or forced outward against the bottom side of the lower header. Beading insures a tight "heat sink" type of contact between the ends of the tubes and the lower header which is desirable to prevent the tube ends from burning which would otherwise cause the container to leak and hence reduce the effective lifetime of the heater.

In the past, beading has been carried out by the use of a small impact type of tool which is carried by a pneumatic hammer. In use, the operator must move the small impact tool to each angular position of the tube around its periphery in order to separately impact each position to form a 360° bead. Beading with such a tool is extremely tedious, time consuming and very noisy.

SUMMARY OF THE INVENTION

It is an object of the present invention to provide an apparatus and process for rapidly and effectively beading a projecting end of a tube to a header or tube sheet and which avoids the above disadvantages.

The apparatus comprises support structure which carries a mandrel adapted to be inserted into the tube to be beaded and which is expandable outward and retractable inward relative to its axis. Also carried by the support structure is a beading head adapted to be moved toward and away from the end of the tube and having an annular beading groove adapted to engage the projecting end of the tube and to force the end of the tube outward against the side of the header. Means is provided for expanding the mandrel outward to tightly grip the inside of the tube near the header and to expand the tube against the header and in addition, means is provided for moving the beading head forward to engage the annular groove with the end of the tube to perform the beading operation.

In carrying out the beading process, the mandrel first is inserted into the end of a tube and expanded to tightly grip the inside of the tube near the header and to expand the tube against the header. The beading head then is moved forward to force the end of the tube outward and against the side of the header.

In the preferred embodiment, the mandrel comprises a spindle having a forward end adapted to be inserted into the tube to be beaded and which comprises at least one outward flaring portion that flares outward and forward at an inclined angle relative to the axis of the spindle. A plurality of jaw members are movably supported around said outward flaring portion of the spindle, each having inner inclined surfaces which mate with the surface of the spindle forming the outward flaring portion. A movable rod is located in a bore extending through the spindle and has its forward end coupled to the forward ends of the jaw members for moving the jaw members forward and rearward to cause their inner inclined surfaces to follow the outward flaring portion of the spindle for moving the jaw members outward and inward respectively. The annular beading head is supported around the spindle rearward of the jaw members. Its annular beading groove is concave in cross section and is formed on the side of the beading head facing rearward end of the jaw members. A hydraulic system is employed to actuate the spindle rod and the beading head for controlling the mandrel and beading head.

BRIEF DESCRIPTION OF THE DRAWINGS

In FIG. 9, certain components of the apparatus have been omitted for purposes of clarity;

DETAILED DESCRIPTION OF THE INVENTION

Figure 1:
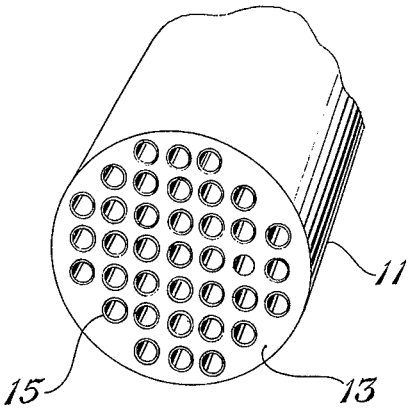
FIG. 1 illustrates the end of a hot water heater having a plurality of heat exchanging tubes extending through a header and which have been beaded to the outer side of the header.
Figure 2:
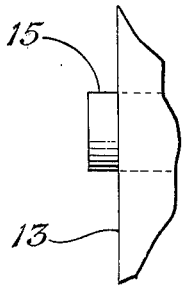
FIG. 2 illustrates the unbeaded end of a tube projecting a short distance beyond the end of the header.
Figure 3:
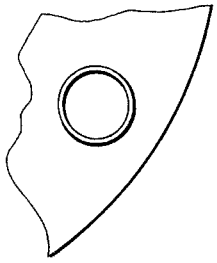
FIG. 3 is a plan view of the tube of FIG. 1.
Figure 4:
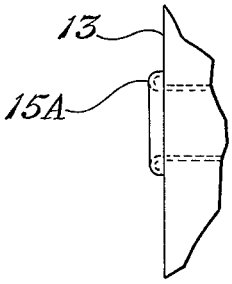
FIG. 4 illustrates the end of the tube of FIG. 2 after it has been beaded against the side of the header.
Figure 5:
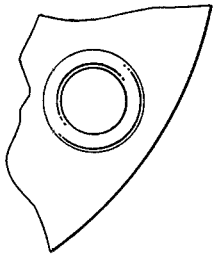
FIG. 5 is a plan view of the beaded tube of FIG. 4.

Referring to FIGS. 1–5, there is illustrated at 11 the end of a cylindrical container of a water heater and which comprises a header or tube sheet 13 with a plurality of heat exchanger tubes extending therethrough with their ends beaded against the outer side of the header 13. As mentioned above, in the process of manufacturing hot water heaters employing heat exchanger tubes, the tubes are inserted through apertures formed in the top and bottom headers with the upper ends of the tubes expanded to the upper header and the lower ends of the tubes projecting outward a short distance beyond the lower header and then beaded outward against the bottom side of the lower header. FIG. 2 illustrates the end of a tube 15 extending through an aperture formed through the header 13 and projecting outward a short distance which may be, for example, 9/16 of an inch beyond the header 13. In the beading process, the projecting end of the tube is forced outward and against the side of the header, as illustrated at 15A in FIG. 4.

Figure 6:
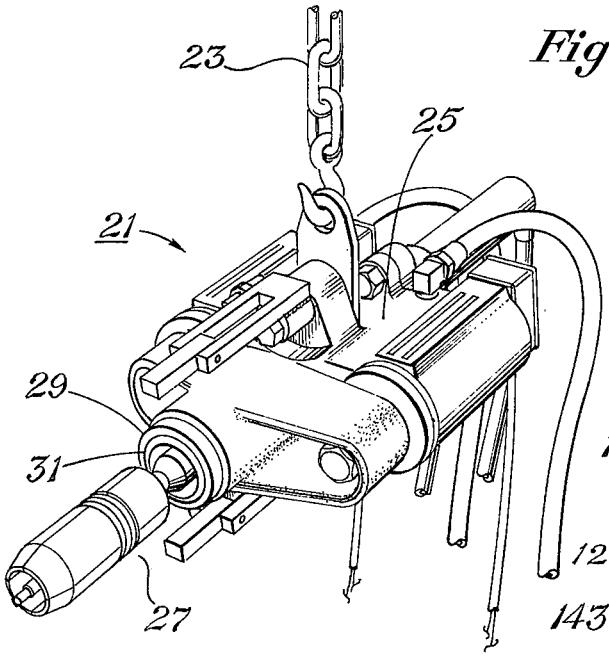
FIG. 6 is a perspective front view of the apparatus of the present invention.
Figure 7:
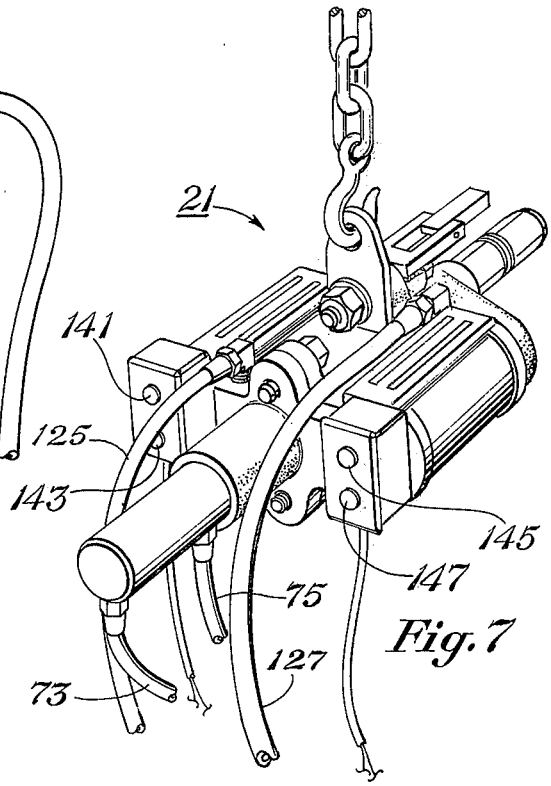
FIG. 7 is a perspective rear view of the apparatus of FIG. 6.
Figure 8:
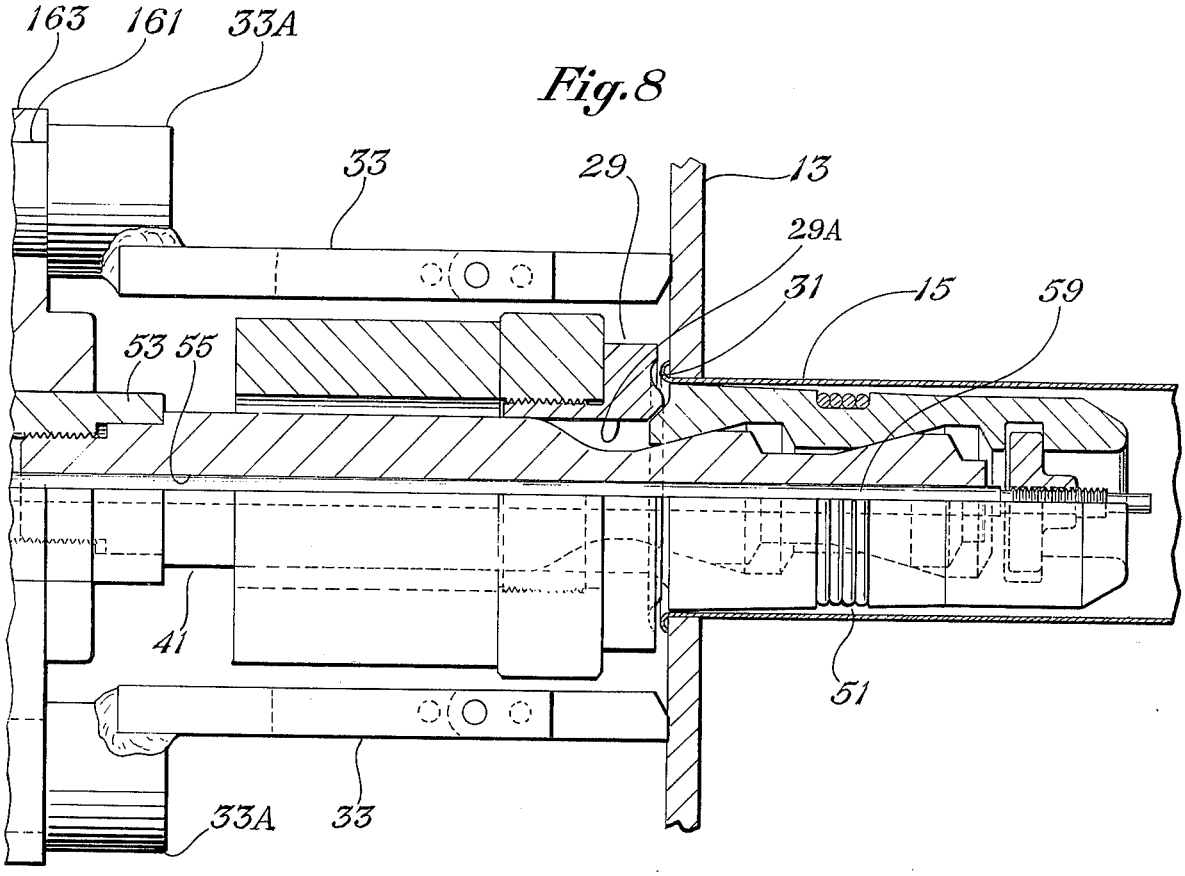
FIG. 8 is a partial cross sectional view of the forward end of the apparatus of the present invention illustrating its expanding mandrel in an expanded position and its beading head moved to a forward position for beading the end of a tube.
Figure 9:
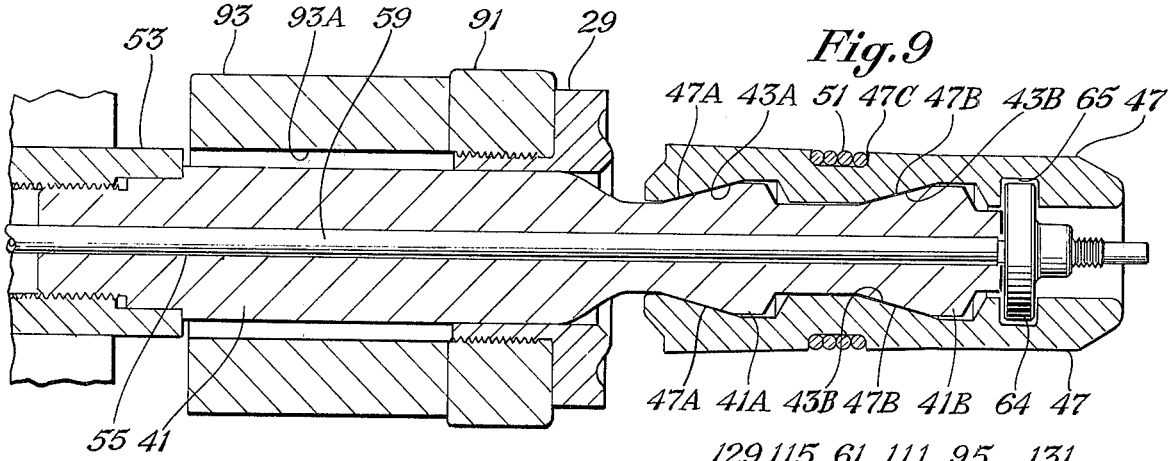
FIG. 9 is a cross sectional view of the apparatus of FIG. 8 illustrating its expanding mandrel in a retracted position and its beading head located in a rearward position.

Referring now to FIGS. 6–13, there will be described the apparatus of the present invention which allows the beading process to be carried out rapidly and effectively. In FIGS. 6 and 7, the apparatus is identified by reference numeral 21 and is shown supported from a chain 23 to allow it to be used to carry out its intended purpose. Basically, the apparatus comprises housing or support structure 25 which carries an expandable mandrel 27 at its front end and an axially movable annular beading head or die 29 located behind the mandrel 27. The front end of the beading head 29 has an annular groove 31, concave in cross section, for beading the projecting end of the tubes to the header of the heater being assembled. The mandrel is adapted to be located in a retracted position, as illustrated in FIG. 9 and expanded outward to an expanded position, as illustrated in FIG. 8. In addition, the beading head 29 is adapted to be located in a rearward retracted position, as illustrated in FIG. 9 and moved to a forward operating position, as illustrated in FIG. 8 for beading purposes. In carrying out the beading process, the mandrel 27 and beading head 29 initially will be in their retracted positions. The mandrel first is inserted into a tube to be beaded, a distance sufficient to allow its rear end to be about even with or slightly inward of the outside surface of the header 13. Two stops 33 are coupled to the housing structure 25 and extend forward a distance such that they will abut against the header during the insertion process when the mandrel has been inserted to the desired position. Thus, the stops 33 facilitate proper insertion of the mandrel 27 which then is actuated to expand the mandrel radially outward to tightly engage the inside surface of the tube and to expand the tube against the header wall 13, thereby rigidly locking the tube and the header wall together while the projecting end of the tube is being beaded to the header wall. Beading is carried out by actuating the beading head 29 to move it forward to allow the curved wall of the groove 31 to engage the end of the tube and to force its end radially outward and against the outside surface of the header wall 13, as illustrated in FIG. 8. Since the groove 31 is annular, all portions of the end of the tube around its 360° perimeter, will be beaded simultaneously, thereby allowing beading to be carried out efficiently and rapidly. After the end of the tube has been beaded, the mandrel 27 and then the beading head 29 will be moved to their retracted positions, after which the mandrel will be removed from the end of the tube. The complete beading operation for beading a single tube can be performed in the order of 2 to 5 seconds. After beading, a complete seal is formed between the tube and the header wall by a rolling operation. Since beading can be carried out so rapidly with the present apparatus, we have found it desirable to bead not only the lower ends of the tubes to the lower header but also the upper ends of the tubes to the upper header in the manufacture of water heaters.

Figure 11:
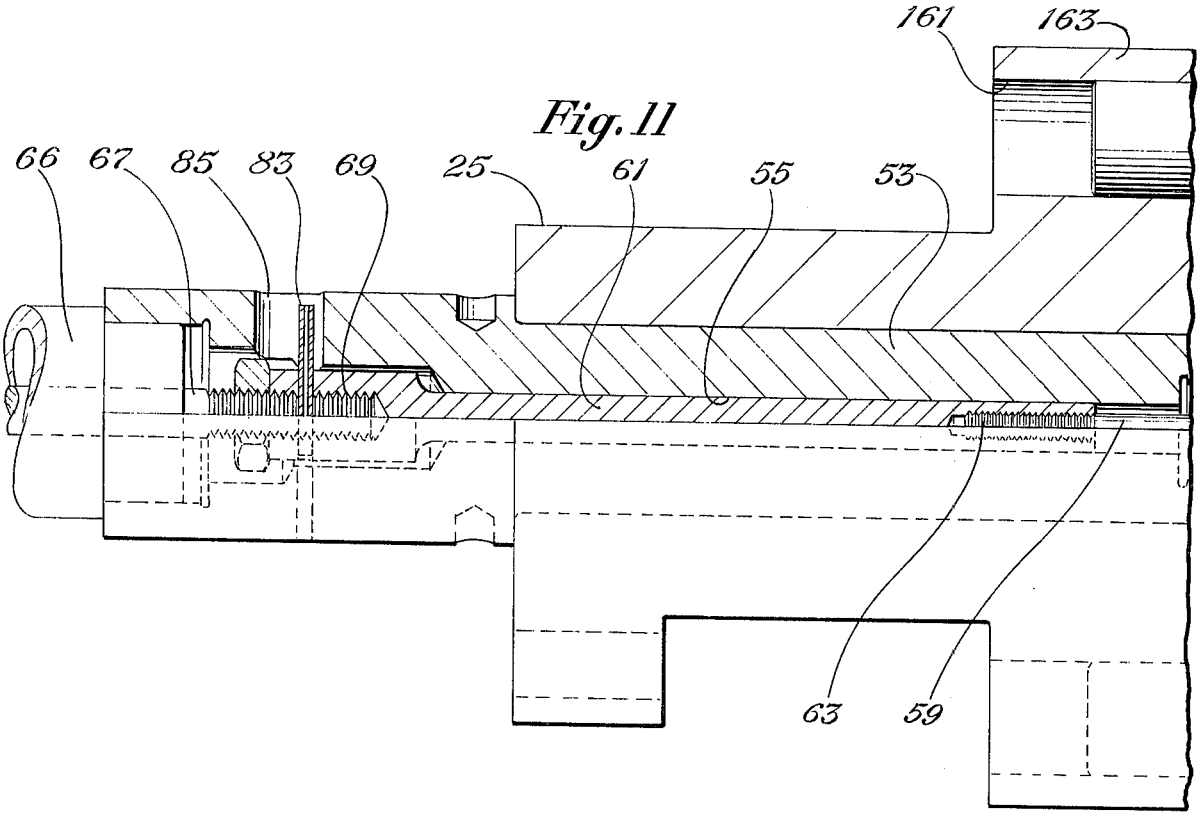
FIG. 11 is a partial cross sectional view of the rear end of the apparatus of FIG. 8 illustrating the rear end of its piston rod and a portion of its hydraulic cylinder for operating the expandable mandrel. The right hand side of FIG. 11 may be placed next to the left hand side of FIG. 8 to illustrate the entire length of the apparatus except for the rear end of the hydraulic cylinder employed for operating the expandable mandrel.

Referring now to FIGS. 8, 9, and 11, the expandable mandrel 27 includes a spindle, comprising a forward spindle member 41, having at its forward end, two outward flaring portions 41A and 41B whose surfaces 43A and 43B flare outward and forward at an inclined angle relative to the axis of the spindle. Movably supported around the flared portions 41A and 41B are four jaw members, two of which are illustrated at 47. The jaw members have two inner inclined surfaces 47A and 47B which mate with the surfaces 43A and 43B of the outward flaring portions 41A and 41B of the spindle 41. When the jaw members are moved forward, their inclined surfaces 47A and 47B will ride up on the outward flaring surfaces 43A and 43B of the spindle to expand the jaw members radially outward, as illustrated in FIG. 8. When the jaw members are moved rearward, their inclined surfaces 47A and 47B will follow the surfaces 43A and 43B downward to radially retract the jaw members, as illustrated in FIG. 9. A spring 51, located in a groove 47C, formed around the periphery of the jaw members holds the jaw members around the spindle but allows the jaw members to be moved forward and rearward and hence outward and inward for expansion and retraction purposes.

Due to the structure of the jaw members, the mandrel is tapered with its rear end having a larger diameter. This allows the mandrel, when expanded, to apply pressure on the inside of the tube on a tapered basis, with the primary pressure being applied at a position centered at the header wall. Pressure also is applied to the tube a distance inward from the header wall to insure that the mandrel will be securely locked to the tube, when expanded, and will not slip during the beading operation.

The rear end of the member 41 of the spindle is threaded to a rear member 53 which is secured to the housing structures 25 of the apparatus whereby the spindle, comprising members 41 and 53, remains fixed relative to the structure 25 of the apparatus. Extending through the spindle along its axis is a central bore 55 within which is located an axially movable rod defined by rod members 59 and 61 which are threaded together at 63, as illustrated in FIG. 11. The forward end of the rod member 59 extends outward beyond the spindle member 41 and has a thrust washer 64 threaded thereto. The washer fits within slots 65 formed on the inside of the jaw members 47 at their forward ends. The rod members 59 and 61 are adapted to be moved forward and rearward for expanding and retracting the jaw members 47 of the expandable mandrel. When the rod members 59 and 61 are moved forward, the washer 64 moves the jaw members 47 forward to move them radially outward, as mentioned previously. When the rod members 59 and 61 are moved rearward, the washer 64 moves the jaw members rearward to locate them in their retracted positions.

Figure 13:
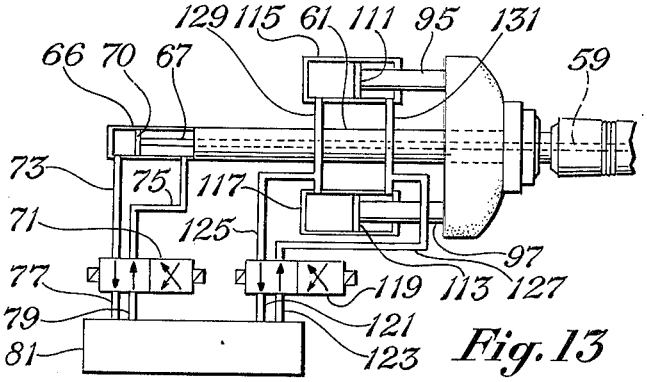
FIG. 13 is a schematic illustrating the hydraulic system and valve arrangement for controlling the expandable mandrel and the beading head of the apparatus of the present invention. This figure is not drawn to scale.

A hydraulic cylinder 66 extends from the rear end of the spindle member 53 for controlling axial movement of the rod members 59 and 61. As illustrated in FIG. 11, the rear end of rod member 61 has a rearward extension rod 67 threaded thereto at 69 and which extends rearward into the hydraulic cylinder 66. The rear end of rod 67 has a piston 70 connected thereto as illustrated in FIG. 13 and which is located within the hydraulic cylinder 66. A solenoid actuated 4-way valve 71 is employed to control the flow of hydraulic fluid to and from the cylinder 66 for controlling the operation of the mandrel. When the valve 71 is moved to the position shown in FIG. 13, the central rod formed by rod members 59, 61 and 67 is moved rearward to retract the mandrel. When the valve 71 is moved to the left, as seen in FIG. 13, the central rod is moved forward to expand the mandrel. The flow of fluid is by way of conduits 73 and 75 and 77 and 79, the latter two of which are coupled to a hydraulic fluid reservoir 81. Extreme two way movement of the central rod formed by rod members 59, 61 and 67 is limited by a pin 83 which is coupled to rod members 61 and 67 as illustrated in FIG. 11 and which is adapted to be moved forward or rearward in a slot 85 formed through the rearward spindle extension 53.

Figure 12:
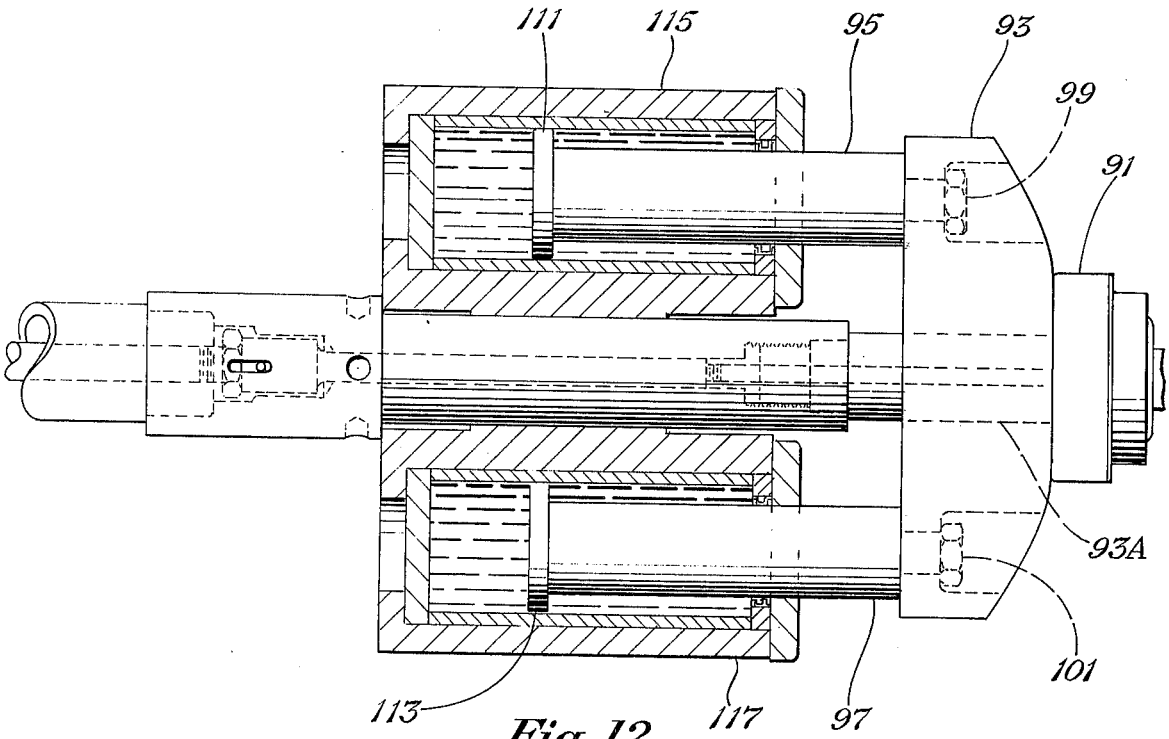
FIG. 12 is a top view of the forward end of the apparatus of the present invention illustrating its hydraulic piston arrangement for actuating the beading head.

A hydraulic cylinder and 4-way valve also is employed for controlling forward and rearward movement of the beading head 29. As seen in FIGS. 8, 9 and 12, the head 29 is threaded to an annular member 91 which is connected to a yoke or frame 93. Annular member 91 surrounds the spindle 41 while the frame 93 has a central bore 93A through which the spindle member 41 extends. The inside diameters of the bore 29A of the head 29 and bore 93A are large enough to allow head 29 and frame 93 to move freely in the forward and rearward directions relative to the spindle. The frame 93 is connected to a pair of piston rods 95 and 97 by way of bolts 99 and 101. The rear of the piston rods 95 and 97 have pistons 111 and 113 connected thereto which are located within hydraulic cylinders 115 and 117 respectively. The cylinders are fixedly secured to the housing structure 25 of the apparatus such that the piston rods 95 and 97 may be moved forward or rearward by control of hydraulic fluid to the cylinders 115 and 117 to move the frame 93 and hence the beading head 29 forward or rearward.

Referring again to FIG. 13, the hydraulic fluid to the cylinders 115 and 117 is controlled by a solenoid actuated 4-way valve 119. Flow to and from the reservoir 81 through the valve 119 is by way of conduits 121 and 123, 125 and 127. Conduit 125 is coupled to the rear end of cylinders 115 and 117 by way of a conduit 129. Similarly, conduit 127 is coupled to the forward end of the cylinders 115 and 117 by way of a conduit 131. Conduits 129 and 131 extend through the housing structure and are not illustrated in the other figures. When the valve 119 is moved to the position shown in FIG. 13, the piston rods 95 and 97 are moved rearward to retract the beading head. When the Valve 119 is moved to the left, as seen in FIG. 13, the piston rods 95 and 97 are moved forward to move the beading head forward.

Referring to FIG. 7, two control buttons 141 and 143 are employed for controlling actuation of the solenoid valve 71 for expanding and retracting the mandrel while two control buttons 145 and 147 are employed for controlling actuation of the solenoid valve 119 for controlling the forward and rearward movement of the beading head. In operation, after the mandrel 27 has been inserted the proper distance into a tube to be beaded, button 141 first is pushed to expand the mandrel. Next, button 145 is pushed to move the beading head forward to bead the end of the tube. After beading, button 143 is pushed to retract the mandrel and finally button 147 pushed to retract the beading head.

Figure 10:
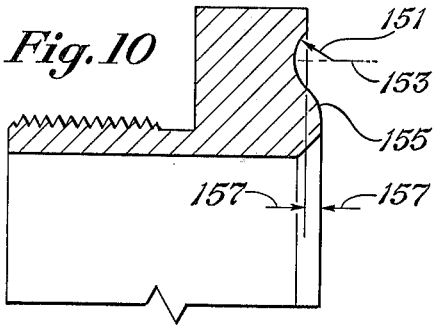
FIG. 10 is an enlarged partial cross section of the beading head of FIGS. 8 and 9.

Referring to FIG. 10, there will be described more detail of one embodiment of the beading head 29 employed for beading tubes having an inside diameter of 2.79 inches and an outside diameter of three inches. The groove 31, in cross section, has a radius of curvature, identified by reference numeral 151, of ¼ of an inch. The diameter of a circle coinciding with the midpoint of the groove, identified by reference numeral 153, is equal to 3.25 inches. The outside diameter of the head 29 is equal to 3.975 inches. The radius of curvature identified at 155 is equal to ¼ of an inch and the distance between arrows 157 is equal to 0.73 of an inch. The stroke of the beading head 29 is 2¾ 3/4 inches. It is to be understood that the beading head may have different dimensions for beading tubes of different sizes.

Referring to FIGS. 8 and 11, the stops 33 are welded to members 33A whose rear ends are fixedly located within apertures 161 formed in structure 163 extending outward from each side of the housing structure 25.

Although the present apparatus was disclosed as being used to bead the ends of hollow tubes employed in water heaters, it is to be understood that the apparatus may be employed to bead such tubes employed in boilers.

I claim:

1. A method of beading to a header, the circular end of a hollow tube extending through an aperture formed through the header and projecting a short distance beyond one side of the header, said method being carried out with the use of an expandable mandrel adapted to be inserted into the tube and an annular non-segmented beading head movable axially relative to said mandrel and having an annular beading groove with inside wall structure adapted to engage the projecting end of the tube and to force the end of the tube outward relative to its axis, said method comprising the steps of:

inserting the mandrel into the end of the tube, expanding the mandrel to apply pressure radially against the inside surface of the tube at a point spaced inward from its projecting end and to tightly grip the tube near the header and to expand the tube against the header, and while said mandrel is expanded, moving the beading head forward relative to said mandrel to engage its groove with the end of the tube to force simultaneously, all portions of the projecting end of the tube around its 360° perimeter radially outward against the side of the header, retracting the mandrel and the beading head, and removing the mandrel from the tube.

2. Apparatus for beading the end of a tube extending through an aperture formed through a header and projecting a short distance beyond one side of the header, comprising:

support structure, a mandrel carried by said support structure and adapted to be inserted into the tube to be beaded and which is expandable outward and retractable inward relative to its axis, a beading head carried by said support structure and adapted to be moved axially relative to said mandrel and toward and away from the end of the tube to be beaded and having an annular beading groove with inside wall structure adapted to engage the projecting end of the tube and to force the end of the tube outward relative to its axis, means for expanding said mandrel outward to tightly grip the inside of the tube near said header and to expand the tube against said header, and means for moving said beading head forward relative to said mandrel and toward the end of the tube to engage said inside wall structure of said annular groove with the projecting end of the tube and to force the end of the tube outward and against the side of the header.

3. The apparatus of claim 2 wherein said means for moving said beading head relative to said mandrel comprises:

beading head actuating meaNs carried by said support structure and coupled to said beading head for moving said beading head forward and rearward.

4. The apparatus of claim 3 comprising:

mandrel actuating means carried by said support structure and coupled to said movable rod for moving said rod in forward and rearward directions relative to said spindle.

5. The apparatus of claim 2 wherein:

said mandrel comprises:

a spindle carried by said support structure and having a forward end adapted to be inserted into the tube to be beaded, a plurality of movable jaw members supported around said forward end for outward and inward movement relative to the axis of said spindle, and means including a portion of said spindle for moving said jaw members outward and inward relative to the axis of said spindle for expanding and retracting said mandrel, said beading head comprises an annular member surrounding said spindle rearward of said jaw members, and supported for axial movement relative to said spindle, said annular beading groove being formed on the side of said beading head facing the rearward end of said jaw members, said means for moving said beading head forward being adapted to move said beading head rearward.

6. The apparatus of claim 2 wherein:

said mandrel comprises:

a spindle carried by said support structure and having a forward end adapted to be inserted into the tube to be beaded, said forward end of said spindle comprising at least one outward flaring portion which flares outward and forward at an inclined angle relative to the axis of said spindle, a plurality of jaw members movably supported around said outward flaring portion of said spindle, said jaw members having inner inclined surfaces which mate with the surface of said spindle forming said outward flaring portion, and means movable relative to said spindle and coupled to said jaw members for moving said jaw members forward and rearward to cause their inner inclined surfaces to follow said outward flaring portion of said spindle for moving said jaw members outward and inward respectively.

7. The apparatus of claim 6 wherein:

said beading head comprises a non-segmented annular member surrounding said spindle rearward of said jaw members and supported for axial movement relative to said spindle, said annular beading groove being formed on the side of said beading head facing the rearward end of said jaw members.

8. The apparatus of claim 6 wherein:

said spindle has a central bore extending therethrough along its axis, said means movable relative to said spindle comprises a movable rod located in said bore and movable in forward and rearward directions, said rod having its forward end coupled to the forward ends of said jaw members for moving said jaw members forward and rearward to cause their inner inclined surfaces to follow said outward flaring portion of said spindle for moving said jaw members outward and inward respectively.

9. The apparatus of claim 8 comprising:

mandrel actuating means carried by said support structure and coupled to said movable rod for moving said rod in forward and rearward directions relative to said spindle.

10. The apparatus of claim 8 wherein:

said beading head comprises a non-segmented annular member surrounding said spindle rearward of said jaw members and supported for axial movement relative to said spindle, said annular beading groove being formed on the side of said beading head facing the rearward end of said jaw members.

11. The apparatus of claim 10 wherein said annular beading groove in cross section is concave.

12. The apparatus of claim 11 comprising:

a hydraulic cylinder coupled to the rear end of said spindle, a piston connected to the rear end of said rod and located within said hydraulic cylinder, valve means for controlling the flow of hydraulic fluid to and from said cylinder for controlling actuation of said rod and hence of said mandrel, a pair of hydraulic cylinders carried by said support structure located on opposite sides of said spindle, piston rods located in said pair of hydraulic cylinders and having forward ends coupled to said beading head, and valve means for controlling the flow of hydraulic fluid to and from said pair of hydraulic cylinders for controlling actuation of their piston rods and hence said beading head.

13. The apparatus of claim 12 comprising:

stop means coupled to the front of said support structure and extending forward to limit the distance to which said mandrel may be inserted into a tube.

* * * * *